US006332437B1

(12) United States Patent
Sieber et al.

(10) Patent No.: US 6,332,437 B1
(45) Date of Patent: Dec. 25, 2001

(54) ADJUSTING UNIT FOR ACTUATING A DEVICE FOR VARIABLE CONTROL OF VALVES OF AN INTERNAL COMBUSTION ENGINE

(75) Inventors: Udo Sieber, Bietigheim; Ulrich Kappenstein, Knittlingen, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/534,980

(22) Filed: Mar. 27, 2000

(51) Int. Cl.[7] ..... F01L 1/34

(52) U.S. Cl. ..... 123/90.15; 123/90.11; 123/90.16; 123/568.24

(58) Field of Search ..... 123/90.15, 90.16, 123/90.11, 568.23, 568.24; 251/129.01, 129.11, 129.12

(56) References Cited

U.S. PATENT DOCUMENTS 4,494,496 * 1/1985 Nakamura et al. ..... 123/90.15
4,498,431 * 2/1985 Nakamura et al. ..... 123/90.15
5,020,487 * 6/1991 Kruger ..... 123/90.15
5,031,582 * 7/1991 Kruger ..... 123/90.15
5,056,476 * 10/1991 King ..... 123/90.16
5,327,856 * 7/1994 Schroeder et al. ..... 123/90.11
5,494,007 * 2/1996 Schroeder et al. ..... 123/90.11
5,497,736 * 3/1996 Miller et al. ..... 123/90.15
5,598,814 * 2/1997 Schroeder et al. ..... 123/90.11
6,012,437 * 1/2000 Radhamohan et al. ..... 251/29.11

* cited by examiner

*Primary Examiner*—Teresa Walberg
*Assistant Examiner*—Fadi H. Dahbour
(74) *Attorney, Agent, or Firm*—Ronald E. Greigg

(57) ABSTRACT

An adjusting unit for actuating a device for variable control of valves of an internal combustion engine for load control of the engine via the inlet stroke function of the valves. The adjusting unit includes a gear unit with a cylindrical worm, on whose circumferential surface a thread is embodied. A displacement element that meshes with the thread of the worm is guided displaceably on the worm, and the displacement element is in communication with an actuating element of the device. A drive unit sets the worm into a rotary motion about its longitudinal axis which drives the displacement element.

17 Claims, 1 Drawing Sheet

ADJUSTING UNIT FOR ACTUATING A DEVICE FOR VARIABLE CONTROL OF VALVES OF AN INTERNAL COMBUSTION ENGINE

BACKGROUND OF THE INVENTION

The present invention relates to an adjusting unit for actuating a device for variable control of valves of an internal combustion engine for load control of the engine via the inlet stroke function of the valves.

A device for variable control of valves of an internal combustion engine can be embodied in various ways in accordance with the prior art. One possible embodiment of such a device for instance has two camshafts, which are rotatable about their longitudinal axes and which act on the valves. The first camshaft determines the open function and the second camshaft determines the close function of the valves. By a relative rotation of the camshafts to one another, the stroke and opening duration of the valves can be varied Such devices are known for instance from the article entitled "Kurbeltrieb fur variable Verdichtung" [Crank Drive for Variable Compression], MTZ Motortechnische Zeitschrift 58 (1977), 11, pages 706–711.

The rotation of the two camshafts relative to one another is effected for instance by means of a multi-wheel coupling gear, of the kind known from German Patent Disclosure DE 42 44 550 A1. In this reference, a so-called variable valve drive is disclosed, in which the rotation of the two camshafts relative to one another is effected by a four-wheeled coupling gear. The wheels of the coupling gear mesh in pairs with one another. The first wheel of the coupling gear, embodied as the drive wheel, is connected to the first camshaft in a manner fixed against relative rotation. The longitudinal axis of the first camshaft coincides with the pivot axis of the drive wheel. The fourth wheel, embodied as a driven wheel, is connected to the second camshaft in a manner fixed against relative rotation. The longitudinal axis of the second camshaft coincides with the pivot axis of the driven wheel. The drive wheel and the driven wheel of the coupling gear do not mesh directly with one another directly but instead mesh via the two wheels of the coupling gear that are embodied as intermediate wheels. In this way, a chain of wheels meshing with one another, extending from the drive wheel through the two intermediate wheels to the driven wheel, is obtained.

The four wheels of the coupling gear are connected to one another via a coupling linkage, which comprises three coupling rods pivotably connected to one another. One end of the first coupling rod is pivotably connected to the pivot axis of the drive wheel, and one end of the third coupling rod is pivotably connected to the pivot axis of the driven wheel. Between the first and the third coupling rods, the second coupling rod is disposed in such a way that the pivot points between the coupling rods are located on the pivot axes of the intermediate wheels.

The drive wheel and the driven wheel mesh with one another via the two intermediate wheels in such a way that a rotary motion of the drive wheel is converted via the intermediate wheels into a contrary rotary motion of the driven wheel. The pivot axes of the two camshafts are disposed so as to be stationary. The first coupling rod, which connects the drive wheel to the first intermediate wheel, is embodied as an actuating lever and lengthened past the pivot axis of the first intermediate wheel. An adjusting unit is pivotably connected to the actuating lever and by it the actuating lever can be pivoted about the pivot axis of the drive wheel. As a result, the coupling linkage is pivoted in a pivoting plane such that the intersection points of the pivot axes of the intermediate wheels with the pivoting plane are located on unambiguously defined paths. When the coupling linkage is pivoted, the driven wheel and thus the second camshaft are rotated in a rotational motion counter to the first camshaft. The rotational motion is the product of a superposition of the pivoting motion of the coupling linkage and the rolling motion of the wheels on one another.

A number of demands are made of the adjusting unit. To achieve unthrottled load control over the entire operating range of modern internal combustion engines, the inlet stroke function of the valves must be adjustable over a wide range. To enable covering such wide adjustment ranges, the adjusting unit must have a relatively long translational adjustment path. In addition, given the demands made of the engine in terms of dynamic operation, it must be possible to traverse this adjustment path within the briefest possible time, that is, within only a few tenths of a second. Finally, the adjusting unit must also be capable of maintaining each set point with high precision, in the face of the pulsating forces of reaction from the valve drive.

From the prior art, it is known to embody the adjusting unit as a hydraulic adjusting unit with a cylinder and a piston. Adjusting units embodied in this way are used to actuate a device for variable control of valves of an internal combustion engine, of the kind known from DE 42 44 550 A1.

Such hydraulic adjusting units are relatively complicated and labor-intensive both to manufacture and to operate and maintain. The result is relatively high costs for such an adjusting unit.

OBJECT AND SUMMARY OF THE INVENTION

The object of the present invention is to create an adjusting unit of the type defined at the outset, which is characterized by

- a gear unit with a cylindrical worm, on whose circumferential surface a thread is embodied, and with a displacement element guided displaceably on the worm, which displacement element has a profiled region that meshes with the thread of the worm, the displacement element being in communication with an actuating element of the device, and
- a drive unit, which sets the worm into a rotary motion about its longitudinal axis.

Activating the drive unit sets the worm into a rotary motion. The rotary motion of the worm is converted into a translational displacement motion of the displacement element. The displacement element is connected to the device for variable control of the valves of an internal combustion engine in such a way that the translational displacement motion of the displacement element results in a control motion of the drive.

Given a suitable embodiment of the worm and/or the displacement element, the adjusting unit of the invention has a long translational adjustment path, so that the inlet stroke function of the valves can be adjusted over a wide range. The entire adjustment path can be traversed within the briefest possible time, and the adjusting unit can maintain every set point with high precision, counter to the pulsating reaction forces from the valve drive.

In an advantageous refinement of the present invention, it is proposed that the drive unit is embodied as an electric motor. An electric motor is an especially simply constructed, powerful, and sturdy way of driving something. Electric motors are economical to produce, simple to operate, and require virtually no maintenance. An adjusting unit with an electric motor can moreover be substantially smaller and lighter in weight than an adjusting unit actuated hydraulically or in some other way.

The displacement element can for instance be embodied as a threaded spindle which has a female thread that meshes with the thread of the worm. In such an adjusting unit, the length of the adjustment path of the adjusting unit is determined by the length of the worm.

In another advantageous refinement of the invention, however, the displacement element is embodied as a rack. On the side of the rack facing the worm, there is a profile which meshes with the thread of the worm. A displacement element embodied as a rack has the advantage that the adjustment path is determined not by the length of the worm but by the length of the rack. As a result, a long adjustment path can be achieved even with a short or in other words small and lighter-weight worm. A short worm, because of its low weight, has less mass inertia and allows especially high startup and braking dynamics, and thus makes rapid adjustment of the inlet stroke function of the valves possible.

The adjusting unit of the invention in this refinement has a translational adjustment path whose length is dependent on the length of the rack. With a suitably long rack, even such large adjustment ranges that the inlet stroke function of the valves can be adjusted over a wide range can also be covered. This adjustment path can also be traversed within the shortest possible time, within a few tenths of a second. This enables especially dynamic engine operation. Finally, because of the worm and rack gear, the adjusting unit of the invention can maintain every set point with high precision, counter to the pulsating reaction forces from the valve drive. As a result of the worm and rack gear, a self-inhibition of the adjusting unit accordingly ensues.

To design the adjusting unit of the invention so that it is as space-saving as possible, it is proposed in a preferred embodiment that the drive unit is disposed relative to the rack such that the rack is movable past the drive unit. The rack is movable over its entire length on the worm, without limitation on the part of the drive unit of the path of motion of the rack toward one side. This has the advantage that with an especially small-sized adjusting unit, a long adjustment path can be attained.

To withstand the high pulsating reaction forces from the valve drive with as much certainty as possible, it is proposed that the thread of the worm be embodied as a flat thread. As a result, on the one hand the self-inhibition of the adjusting unit can be improved, and on the other, the play between the worm and the displacement element can be reduced to a minimum.

In a preferred embodiment, the displacement element is in communication with the device via a hinge element. Advantageously, the displacement element has a first receiving element, with which a second receiving element of the hinge element is in frictional engagement. Preferably, the first receiving element is embodied as a circular opening, and the second receiving element is embodied as a peg with a circular cross-sectional surface, and the outside diameter of the peg is greater than the inside diameter of the opening. As a result, the self-inhibition of the adjusting unit can be reinforced.

In another advantageous refinement of the present invention, the gear unit has a support frame, in which the worm is supported rotatably and the displacement element is supported displaceably, and the end faces of the worm are braced on the support frame. As a result of this refinement of the invention, the pulsating reaction forces from the valve drive are introduced via the end faces of the worm directly into the support frame and are not transmitted to the drive unit. Especially gentle operation of the drive unit is thus made possible.

The invention will be better understood and further objects and advantages thereof will become more apparent from the ensuing detailed description of preferred embodiments taken in conjunction with the drawing.

DESCRIPTION OF THE PREFERRED EMBODIMENTS

Figure 1:
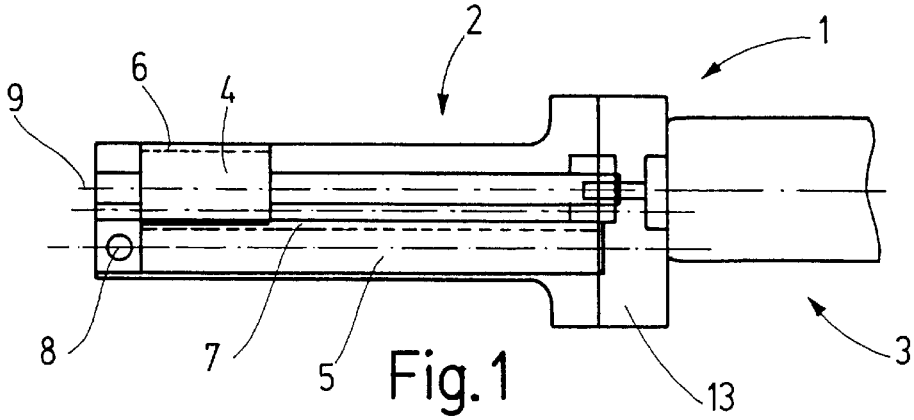
FIG. 1 shows a first embodiment of an adjusting unit of the invention.

FIG. 1 shows an adjusting unit 1 of the invention in its entirety. The adjusting unit 1 is used to actuate a device for variable control of valves of an internal combustion engine, especially for load control of the engine via the inlet stroke function of the valves.

The adjusting unit 1 of the invention has a gear unit 2 and a drive unit 3. The gear unit 2 has a cylindrical worm 4 and a displacement element 5 guided displaceably on the worm 4. A wormlike thread 6 is formed on the circumferential surface of the worm 4. The displacement element 5 is embodied as a rack, on the top of which is a profile 7 which is in meshing engagement with the thread 6 of the worm 4. A circular opening 8 is embodied on one end of the displacement element 5, and by way of this opening the displacement element 5 is in communication with an actuating element 11 (see FIG. 2) of the device for variable control of the valves of the engine.

The drive unit 3 is embodied as an electric motor and sets the worm 4 into a rotary motion about its longitudinal axis 9. The rotary motion of the worm 4 is converted into a translational displacement motion of the displacement element 5. The translational displacement motion of the displacement element 5 results in a control motion of the device for variable control of the valves.

Figure 2:
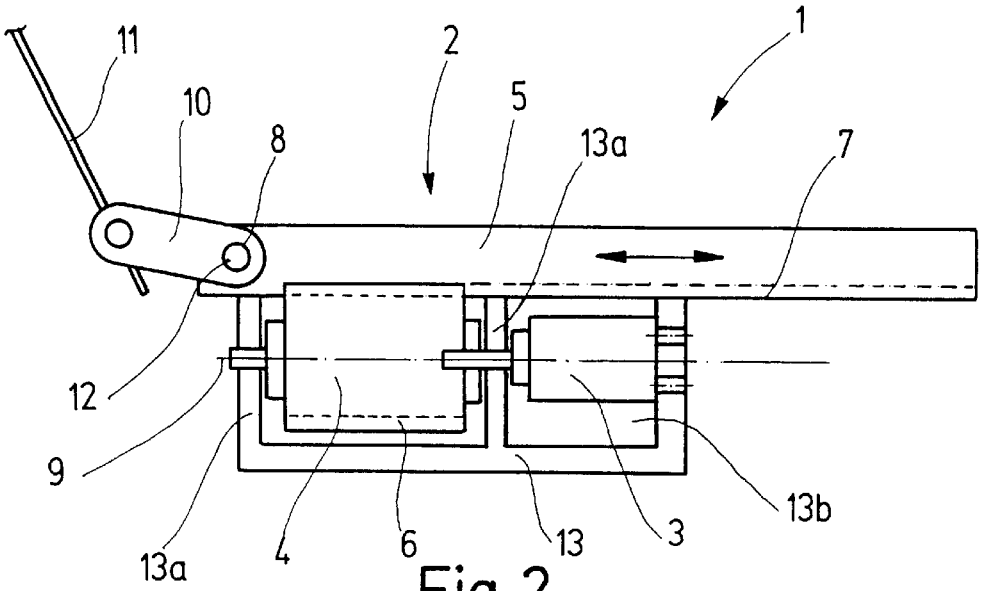
FIG. 2 shows a second embodiment of an adjusting unit of the invention.

In the embodiment of the adjusting unit 1 of the invention as shown in FIG. 2, the drive unit 3 is disposed relative to the displacement element 5 in such a way that the displacement element 5 can be moved past the drive unit 3. More precisely, the drive unit 3 embodied as an electric motor has a smaller diameter than the worm 3, and as a result the displacement element 5 embodied as a rack is movable above the drive unit 3. The displacement element 5 communicates with the actuating element 11 of the device for variable control of the valves via a hinge element 10. The hinge element 10 has a peg 12 with a circular cross-sectional surface, whose outside diameter is greater than the inside diameter of the opening 8. The peg 12 is in frictional engagement with the opening 8.

The gear unit 2 has a support frame 13, in which the worm 4 is supported rotatably and the displacement element 5 is supported displaceably. The end faces of the worm 4 are braced on the support frame 13 in the region of the horizontal parts 13*a* of the support frame. In the adjusting unit 1 shown in FIG. 2, the support frame 13 is lengthened past the gear unit 2 and has a region 13*b*, in which the drive unit 3 is disposed.

Figure 3:
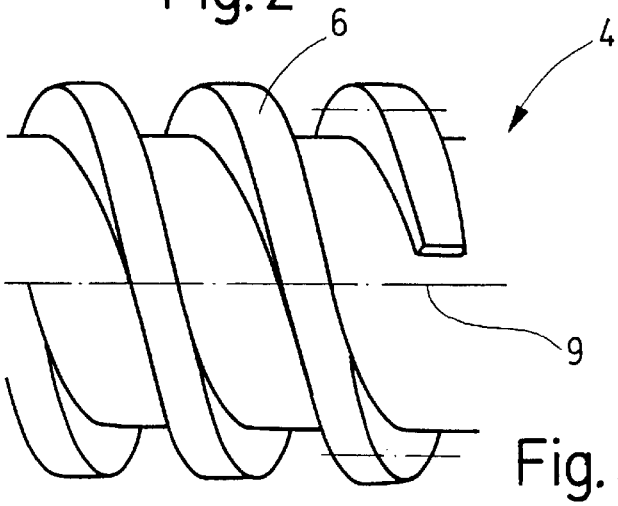
FIG. 3 shows the worm of the adjusting units of FIGS. 1 and 2.

In FIG. 3, the worm 4 is shown in an enlarged detail. It can be clearly seen that the thread 6 of the worm 4 is embodied as a flat thread.

The foregoing relates to preferred exemplary embodiments of the invention, it being understood that other variants and embodiments thereof are possible within the spirit and scope of the invention, the latter being defined by the appended claims.

We claim:

1. An adjusting unit (1) for actuating a device for variable control of valves of an internal combustion engine for load control of the engine, comprising a gear unit (2) with a cylindrical worm (4), a thread (6) is embodied on a circumferential surface of said worm (4), a displacement element (5) is guided displaceably on the worm (4), which displacement element has a profiled region (7) that meshes with the thread (6) of the worm (4), the displacement element (5) is in communication with an actuating element (11) of the device, and a drive unit (3), which sets the worm (4) into a rotary motion about a longitudinal axis (9) of the worm, wherein the displacement element (5) is embodied as a rack.

2. The adjusting unit (1) according to claim 1, in which the drive unit (3) is embodied as an electric motor.

3. The adjusting unit (1) according to claim 1, in which the drive unit (3) is disposed relative to the rack such that the rack is movable past the drive unit (2).

4. The adjusting unit (1) according to claim 3, in which the thread (6) of the worm (4) is embodied as a flat thread.

5. The adjusting unit (1) according to claim 3, in which the displacement element (5) is in communication with the device via a hinge element (10).

6. The adjusting unit (1) according to claim 1, in which the thread (6) of the worm (4) is embodied as a flat thread.

7. The adjusting unit (1) according to claim 1, in which the displacement element (5) is in communication with the device via a hinge element (10).

8. The adjusting unit (1) according to claim 1, in which the gear unit (2) has a support frame (13), in which the worm (4) is supported rotatably and the displacement element (5) is supported displaceably, and the end faces of the worm (4) are braced on the support frame (13).

9. An adjusting unit (1) for actuating a device for variable control of valves of an internal combustion engine for load control of the engine, comprising a gear unit (2) with a cylindrical worm (4), a thread (6) is embodied on a circumferential surface of said worm (4), a displacement element (5) is guided displaceably on the worm (4), which displacement element has a profiled region (7) that meshes with the thread (6) of the worm (4), the displacement element (5) is in communication with an actuating element (11) of the device, and a drive unit (3), which sets the worm (4) into a rotary motion about a longitudinal axis (9) of the worm, and wherein the thread (6) of the worm (4) is embodied as a flat thread.

10. The adjusting unit (1) according to claim 9, in which the drive unit (3) is embodied as an electric motor.

11. The adjusting unit (1) according to claim 9, in which the displacement element (5) is in communication with the device via a hinge element (10).

12. An adjusting unit (1) for actuating a device for variable control of valves of an internal combustion engine for load control of the engine, comprising a gear unit (2) with a cylindrical worm (4), a thread (6) is embodied on a circumferential surface of said worm (4), a displacement element (5) is guided displaceably on the worm (4), which displacement element has a profiled region (7) that meshes with the thread (6) of the worm (4), the displacement element (5) is in communication with an actuating element (11) of the device, and a drive unit (3), which sets the worm (4) into a rotary motion about a longitudinal axis (9) of the worm, and wherein the displacement element (5) is in communication with the device via a hinge element (10).

13. The adjusting unit (1) according to claim 12, in which the drive unit (3) is embodied as an electric motor.

14. The adjusting unit (1) according to claim 12, in which the displacement element (5) has a first receiving element, with which a second receiving element of the hinge element (10) is in frictional engagement.

15. The adjusting unit (1) according to claim 14, in which the first receiving element is embodied as a circular opening (8), and the second receiving element is embodied as a peg (12) with a circular cross-sectional surface, and an outside diameter of the peg (12) is greater than an inside diameter of the opening (8).

16. An adjusting unit (1) for actuating a device for variable control of valves of an internal combustion engine for load control of the engine, comprising a gear unit (2) with a cylindrical worm (4), a thread (6) is embodied on a circumferential surface of said worm (4), a displacement element (5) is guided displaceably on the worm (4), which displacement element has a profiled region (7) that meshes with the thread (6) of the worm (4), the displacement element (5) is in communication with an actuating element (11) of the device, and a drive unit (3), which sets the worm (4) into a rotary motion about a longitudinal axis (9) of the worm, and wherein the gear unit (2) has a support frame (13), in which the worm (4) is supported rotatably and the displacement element (5) is supported displaceably, and the end faces of the worm (4) are braced on the support frame (13).

17. The adjusting unit (1) according to claim 16, in which the drive unit (3) is embodied as an electric motor.

* * * * *